United States Patent [19]

Cioffi et al.

[11] 4,274,587

[45] Jun. 23, 1981

[54] WATER COOLED BURNER NOZZLE FOR SOLVENT REFINED COAL

[75] Inventors: Paul L. Cioffi, Massillon; William Downs, Alliance; William C. Kish; William E. Newkirk, both of Akron, all of Ohio

[73] Assignee: Electric Power Research Institute, Inc., Palo Alto, Calif.

[21] Appl. No.: 5,041

[22] Filed: Jan. 22, 1979

[51] Int. Cl.[3] ..... B05B 15/00

[52] U.S. Cl. ..... 239/132.3; 110/104 B; 431/160

[58] Field of Search ..... 239/132.1, 132.3, 133, 239/139, 13; 431/160; 110/104 B

[56] References Cited

U.S. PATENT DOCUMENTS

| | | | |
|---|---|---|---|
| 1,920,769 | 8/1933 | Stevenson, Jr. | 431/160 X |
| 2,335,188 | 11/1943 | Kennedy | 431/160 X |
| 2,460,861 | 2/1949 | Walters | 239/132.1 |
| 3,239,205 | 3/1966 | Metz | 239/132.3 |

FOREIGN PATENT DOCUMENTS

| | | | |
|---|---|---|---|
| 222679 | 5/1958 | Australia | 431/160 |
| 594774 | 3/1960 | Canada | 239/132.3 |
| 2262 | of 1888 | United Kingdom | 239/132.1 |

*Primary Examiner*—Bruce H. Stoner, Jr.
*Assistant Examiner*—Michael J. Forman
*Attorney, Agent, or Firm*—Townsend and Townsend

[57] ABSTRACT

A burner nozzle for solvent refined coal (SRC) is disclosed having means for removing heat which is adequate to maintain the exterior temperature of the burner nozzle below the level at which deposition of SRC residue has been observed. A specific embodiment comprises a water jacket about a tubular nozzle, the fuel outlet end being tapered to an edge at the fuel outlet end. The water jacket is provided with circumferential channels for circulating cooling fluid in a circuitous path around the nozzle. The channels are sized so that maximum flow velocity, and therefore maximum convective heat transfer, is maintained at the tapered edge.

7 Claims, 7 Drawing Figures

WATER COOLED BURNER NOZZLE FOR SOLVENT REFINED COAL

BACKGROUND OF THE INVENTION

This invention relates to techniques for firing solvent refined coal (SCR) in a manner to inhibit deposition of SRC residue on burner components.

Solvent refined coal (SRC) is a useful fuel for applications such as the firing of furnaces for utility boilers in fossil-fueled electric power generating plants. It has been discovered however that SRC has a tendency to foul known burner nozzles under typical operating conditions, which causes a loss of efficiency and eventual burner failure. Depositions of SRC residue have been found to be caused particularly at initial firing after out-of-service periods of the nozzle and more particularly during the firing of an SRC burner in a preheated furnace.

SUMMARY OF THE INVENTION

According to the invention, a burner nozzle for solvent refined coal (SRC) is provided having means for removing heat from the nozzle which is adequate to maintain the exterior temperate of the nozzle below the level at which the deposition of SRC residue occurs, specifically at least about 150° F. (about 65° C.). A specific embodiment of a burner nozzle comprises a tubular chamber adapted to be located in a circular burner throat and a hollow jacket about the circumference of the tubular chamber, the hollow jacket being tapered to an edge at the outlet end of the chamber and having an interior divided into cooling fluid channels which direct cooling fluid in a circuitous circumferential path about the tubular chamber. The circumferential chamber adjacent the fuel outlet end of the nozzle is of a cross-section constraining fluid flow therethrough to be at a substantially greater velocity than the velocity of flow of cooling fluid between the first channel and the fuel inlet end of the burner nozzle.

Preliminary attempts were made without success to overcome the problem of SRC residue deposition on burner parts. In the course of development of this invention, the problem of deposition of SRC residue in SRC burner nozzles has been determined to be attributable to heating and melting of SRC on the exposed portions of the nozzle. This discovery has suggested that the solution is one of providing adequate cooling, and in particular of providing adequate heat removal sufficient to maintain the temperature of the nozzle at or below the critical temperature point for SRC residue deposition under all conditions. It has been determined that the maximum permissible nozzle temperature is about 150° F. (about 65° C.).

A simple water jacket capable of circulating a cooling fluid such as water around the operational parts of the nozzle has been discovered to be deficient. The simple water jacket contained no provisions for channeling the cooling fluid in a manner to maintain high velocity with relatively low flow rates. Moreover, an exposed spiral wound cooling coil external of the burner nozzle has also been discovered to be deficient. Both of these cooling techniques have been found to provide inadequate heat removal and to result in deposition of SRC residue on the burner tip and exposed parts as a consequence of eddy formation and back recirculation of hot particles and fluid flowing around the nozzle.

The invention herein described is addressed to a solution of the problems uncovered. A detailed description of specific embodiments of the invention is provided hereinafter in connection with the following drawings.

DETAILED DESCRIPTION OF SPECIFIC EMBODIMENTS

Figure 1:
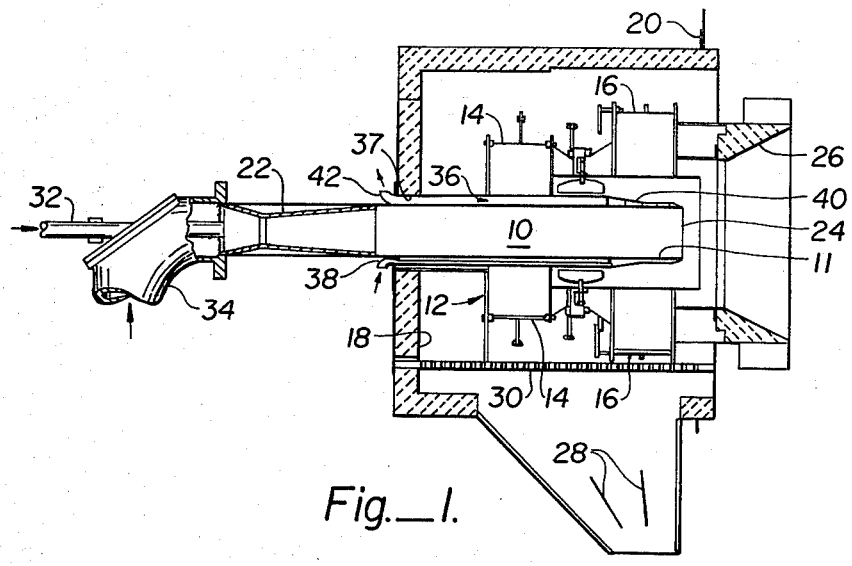
FIG. 1 is a side cross-sectional view of a dual register burner with a water-cooled nozzle according to the invention.

In FIG. 1, the environment of the invention is shown. In particular there is shown a specific SRC nozzle 10 in a burner 12 having dual registers 14 and 16. The burner 12 is mounted in a windbox 18 of a furnace wall 20. A venturi throat 22 is operative to introduce a controllable amount of pulverized SRC and primary air into the nozzle 10. The registers 14 and 16 are operative to introduce secondary air (or other gases supporting combustion) concentrically in a circulating pattern about a fuel outlet end 24 of the nozzle 10 in a burner throat 26. Diverter plates 28 and a perforated plate 30 are provided in the air inlet path of the windbox 18 in order to distribute air flow. Fuel ignitors and flame sensers are not shown.

The nozzle 10 comprises a hollow, generally straight circularly cylindrical tube 11 defining a chamber. At its fuel inlet end, the venturi throat 22 is coupled to an SRC inlet pipe 32 and a primary air inlet duct 34. An annular cooling fluid jacket 36 formed by a shell 37 encases the tube 11 within the windbox 18. A cooling fluid inlet pipe 38 feeds through the windbox wall within a length of the jacket 36 to a duct region 40 near the fuel outlet end 24. A cooling fluid outlet 42 is provided from the rear of the jacket 36 outside of the windbox 18.

FIGS. 2 through 7 illustrate the nozzle 10 and specifically the duct region 40 in greater detail. Common numerals are used to refer to like features in all figures.

Figure 3:
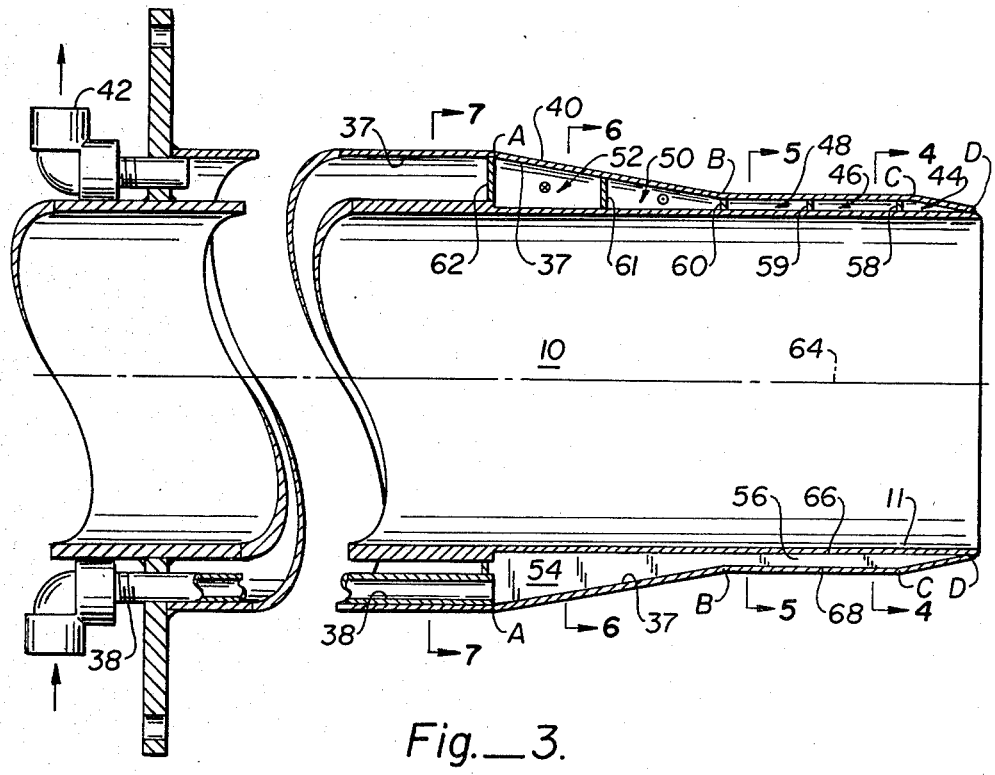
FIG. 3 is a side cross-sectional view in partial cutaway showing the nozzle of FIG. 2, according to the invention.
Figure 2:
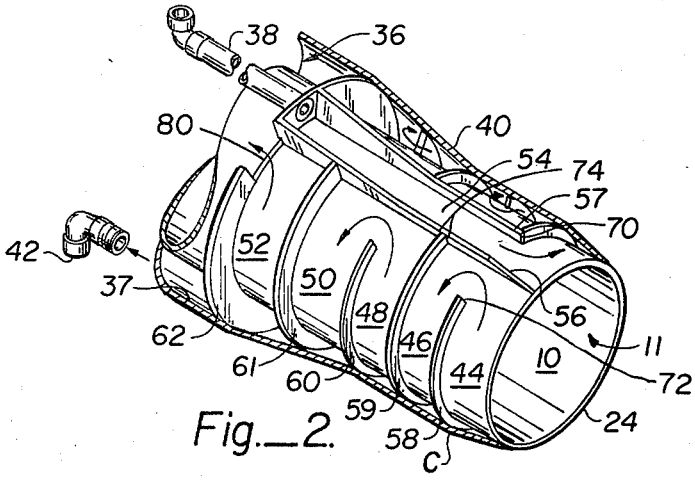
FIG. 2 is a perspective view in partial cutaway of a water-cooledd nozzle for firing solvent refined coal (SRC), according to the invention, the view being partially inverted relative to FIG. 3 for clarity.
Figure 4:
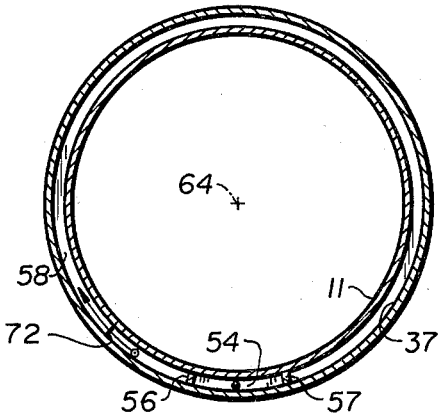
FIG. 4 is a cross-sectional view taken at 4—4 of FIG. 3.
Figure 5:
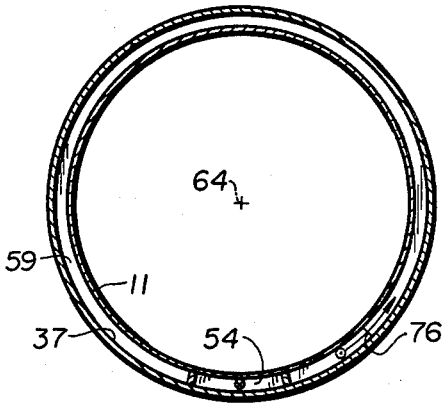
FIG. 5 is a cross-sectional view taken at 5—5 of FIG. 3.
Figure 6:
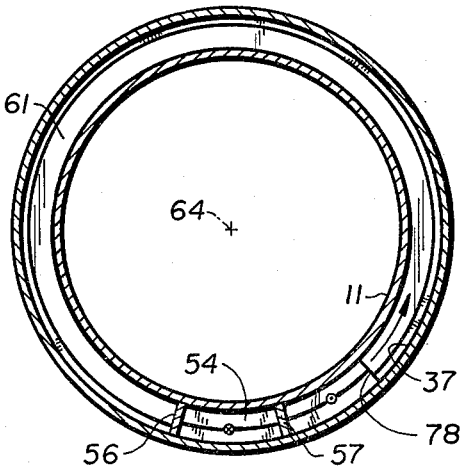
FIG. 6 is a cross-sectional view taken at 6—6 of FIG. 3.

Specifically referring to FIGS. 2 and 3, a specific SRC nozzle 10 comprises tube 11 having a relatively thin cooling fluid jacket 36 formed by shell 37 with even thinner duct region 40 having circumferentially arranged, serially interconnecting channels 44, 46, 48, 50 and 52 about the nozzle tube 11. A longitudinally arranged channel 54 is coupled between inlet pipe 38 and first circumferential channel 44 nearest the outlet end 24. The circumferential channels 44, 46, 48, 50 and 52 are sized to provide fluid flow in first channel 44 at the fuel outlet end 24 at a flow velocity substantially higher than in the remainder of the circumferential channel, and in particular about twice the velocity of the fluid flowing in the second and third of the channels 46 and 48. The fluid inlet pipe 38 is disposed to feed the longitudinal channel 54 in order to direct the coolest fluid first to the highest temperature region of the nozzle 10, namely the circumferential channel 44 adjacent the fuel outlet end 24, thereby maximizing heat transfer characteristics.

As an important feature of the invention, the external profile of the shell 37 of the outlet end 24 is tapered to an edge so that the first circumferential channel 44 is as close as practicable to the outlet end 24, without adding unduly to wall thickness of the nozzle 10. These features minimize the likelihood of eddy formation, which contributes to resistance to deposition of SRC residue at the outlet end 24.

The six channels 44, 46, 48, 50, 52 and 54 in the duct region 40 are formed of flat stock materials of selected shape which are emplaced between the shell 37 and the tube 11 at selected locations. Seven flat plates 56–62 define the six channels as follows.

The first plate 56 conforms to the longitudinal profile of the space between the exterior surface of the tube 11 and the interior surface of the shell 37 along the length of the duct region 40 in a longitudinal plane including the central axis 64 of the tube 11. In the specific embodiment with reference to FIG. 3, inwardly disposed edge 66 (relative to the central axis 64) is straight and the outwardly disposed edge 68 is tapered between a point A and point B at a narrower width, and then is parallel to the inwardly disposed edge 66 between point B and point C. From point C, the outwardly disposed edge 68 generally follows a straight taper to a terminal point D of substantially zero width.

The second plate 57 is substantially identical to the first plate 56 except that it terminates at an edge 70 at or near point C (FIG. 2). As can be seen from FIGS. 2, 4, 5 and 6, the first plate 56 and the second plate 57 are disposed in longitudinal planes intersecting along the central axis 64, thereby forming the longitudinal channel 54 from the inlet pipe 38 to the first circumferential channel 44.

The circumferential channels 44, 46, 48, 50 and 52 are separated from one another by plates 58–61, which are shaped as shown most clearly in FIGS. 2, 4, 5, 6 and 7. Each of the plates 58–61 is typically annular in shape having a span conforming to the space between the tube 11 and the shell 37 in preselected planes substantially perpendicular to the central axis 64. The annulus of each plate 58–61 is provided with an opening approximately twice the tangential width (relative to the surface of tube 11) of the circumferential channel 54.

The third plate 58 has a first edge across its annulus which terminates abutting to the second plate 57 near the terminal edge 70. This first edge at edge 70 defines a transition between the first circumferential channel 44 and the longitudinal channel 54. The third plate 58 has a further edge 72 (FIG. 4) across its annulus along its opening, which edge 72 defines the transition point between the first circumferential channel 44 and the second circumferential channel 46. Opposite sides of the third plate 58 form a common wall between first and second circumferential channels 44 and 46. One side of the first plate 56 forms a wall common to both the first and second circumferential channels 44 and 46, and it further serves as a barrier operative to reverse the circumferential flow path of cooling fluid flowing from the first circumferential channel 44 to the second circumferential channel 46.

The space between edge 72 and the plate 56 is typically the width of the second circumferential channel 46 so that the cross-sectional area of such space and the cross-sectional area of the second circumferential channel 46 are approximately equal. The cross-sectional area of the first circumferential channel 44 is approximately one-half the cross-sectional area of the second circumferential channel 46.

Opposite sides of the fourth plate 59 form a common wall between the second circumferential channel 46 and the third circumferential channel 48. A first edge 74 of the fourth plate 59 abuts to the first plate 56. A second edge 76 defines the transition point between the second circumferential channel 46 and the third circumferential channel 48.

One side of the second plate 57 forms a wall common to both the second circumferential channel 46 and the third circumferential channel 48, and it further serves as a barrier for reversing the circumferential flow path from the second circumferential channel 46 to the third circumferential channel 48.

The fifth plate 60 and the sixth plate 61 are similarly shaped and disposed relative to the first and second plates 56, 57, and are operative to reverse the circumferential flow paths, thereby providing a circuitous track from the inlet of the first circumferential channel 44 to the outlet of the fifth circumferential channel 52. For example, an edge 78 of the sixth plate 61 defines the transition point between the fourth circumferential channel 50 and the fifth circumferential channel 52.

Figure 7:
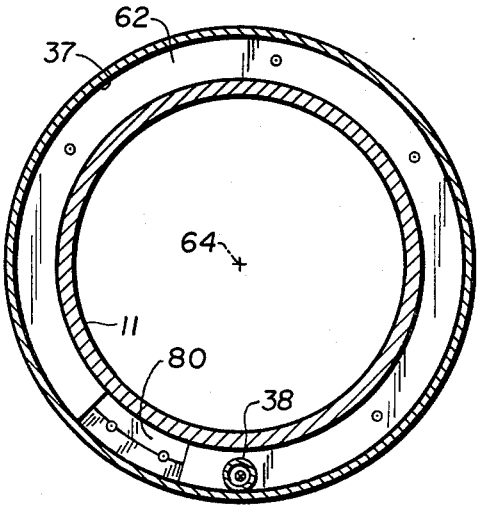
FIG. 7 is a cross-sectional view taken at 7—7 of FIG. 3.

The seventh plate 62 defines the terminus of the duct region 40, providing an opening for sealed connection of the inlet pipe 38 into the longitudinal channel 54, and further providing an outlet opening 80 for the fifth circumferential channel 52 into the cooling fluid outlet region within the shell 37 (FIG. 7).

The wall thickness of the tube 11 in the duct region 40 is preferably as thin as possible in order to promote good heat transfer characteristics near sources of heat. The wall thickness of the tube 11 need not be as great as the remaining portion of the nozzle 10, as noted in FIGS. 3 and 7.

The nozzle 10 operates as follows to inhibit fouling from SRC residue: A cooling fluid, preferably water, at a temperature substantially below about 150° F. is introduced into the fluid inlet port of inlet pipe 38. The cooling fluid is then directed through longitudinal channel 54 to the circumferential channels 44, 46, 48, 50 and 52 in that order in a circuitous circumferential path within the duct region 40. The velocity of the flow is sufficient to maintain the exposed exterior surfaces of the nozzle 10 below at least about 150° F. at all times. In particular, the flow velocity in the first circumferential channel 54 is by the nature of its cross-sectional size maintained at at least about twice as high as the flow velocity in the remaining circumferential channels in the duct region. In this manner, heat transfer is maximized adjacent the fuel outlet end 24 of the nozzle 10. Since the temperature is maintained below about 150° F., the fouling by SRC residue is minimized.

The invention has now been explained with reference to specific embodiments. Various modifications, alternate constructions and equivalents may be employed without departing from the true spirit and scope of the invention. Therefore, the above description and illustrations should not be construed as limiting the scope of the invention, which is defined by the appended claims.

What is claimed is:

1. A fouling inhibiting burner nozzle for a solvent refined coal fuel burner comprising:

means defining a tubular chamber having a fuel inlet and a fuel outlet end, said chamber defining means being located in a burner throat;

means defining a hollow jacket isolated from said chamber along the circumference of said chamber defining means, said jacket defining means having a first port for inlet of liquid cooling fluid and a second port for outlet of liquid cooling fluid adjacent said full inlet end;

said jacket defining means comprising a thin-walled shell means defining a taper along said chamber from a first point to a second point which is at said fuel outlet end and which terminates in a sharp edge of minimal wall thickness and minimal jacket thickness around said fuel outlet end for minimizing the likelihood of eddy formation by fluids and the like flowing externally along said chamber; and means defining a plurality of channels for the cooling fluid within said jacket defining means, said channel defining means defining a first channel having a fluid inlet and a fluid outlet, said first channel being circumferentially disposed about said chamber defining means between said first point and said second point adjacent said fuel outlet end and within said taper communicating with said first port for directing cooling fluid flow in a first direction circumferentially about said chamber defining means, and a second channel having an inlet communicating with the first channel fluid outlet and an outlet in fluid communication with said second port, said second channel having a substantially larger cross-sectional area in the direction of flow of cooling fluid therein than said first channel and being circumferentially disposed between said first channel and said fuel inlet end about said chamber defining means for directing cooling fluid circumferentially about said chamber defining means, the fluid velocity in said first channel being substantially greater than fluid velocity in said second channel without changing the volume rate of flow in response to uniform pressure in order to maximize cooling of said nozzle adjacent said outlet end with cooling fluid in a manner sufficient to inhibit deposition of solvent refined coal residue on said chamber defining means at said edge.

2. The burner nozzle as claimed in claim 1 wherein said first circumferential channel has a cross-sectional area at least about one-half of the cross-sectional area of said second circumferential channel and wherein said second circumferential channel is the sole fluid outlet for said first circumferential channel such that fluid in said first channel is constrained to flow at a rate at least about twice the velocity rate of flow of fluid in said second circumferential channel for enhancing convective heat transfer at said fuel outlet end as compared to convective heat transfer in regions between said first circumferential channel and said fuel inlet end.

3. The burner nozzle as claimed in claim 1 further including means defining a third channel longitudinally extending along said chamber defining means within said hollow jacket defining means between said first inlet port and said first circumferential channel for initially conveying cooling fluid to said first circumferential channel in order to provide coolest cooling fluid to areas of highest temperature at said fuel outlet end.

4. The burner nozzle as claimed in claim 3 wherein said channel defining means of said plurality of channels comprises:

an interior surface wall of said jacket defining means;

an exterior wall of said chamber defining means, said exterior surface wall being spaced from and opposing said interior surface wall;

a first plate disposed longitudinally between said fuel inlet end and extending to a termination of said fuel outlet end and also extending from said exterior surface wall to said interior surface wall;

a second plate substantially parallel with said first plate and disposed longitudinally between said fuel inlet end and extending to a termination at said first circumferential channel and also extending from said exterior surface wall to said interior surface wall, said first and said second plate thereby defining said third longitudinal channel; and a third plate of an annular shape having first and second generally opposing edges defining a void in circumference, said circumference void being of sufficient cross-sectional size to accommodate the cross-sectional sizes of both said first channel inlet and outlet, said third plate being disposed circumferentially about said chamber between said exterior surface wall and said interior surface wall, said first edge being disposed at said termination of said second plate, and said second edge being disposed on the reverse side of said first plate relative to said first edge such that said first edge is at said first channel inlet and said second edge is at said first channel outlet.

5. The burner nozzle as claimed in claim 4 further including a fourth plate of an annular shape having first and second edges defining a void in circumference, said circumference void being of sufficient size to accommodate the cross-sectional sizes of both said third channel and outlet of fluid from said second channel, said first edge being abutted to said first plate on its surface outside of said third channel, thereby to define a circuitous fluid path from said third channel through said first channel and through said second channel toward said fluid outlet port and wherein said annular-shaped plates are spaced at equidistant multiples of the separation between said third plate and said fuel outlet end.

6. The burner nozzle according to claim 3 further including means defining a fourth channel, said fourth channel being circumferentially disposed about said chamber defining means and in fluid communication between said second circumferential channel and said fluid outlet port, and wherein said first circumferential channel, said second circumferential channel and said third circumferential channel are separated by first and second annular plates extending circumferentially between a surface of said chamber defining means and a surface of said jacket defining means, said first and second plates having voids therethrough, said voids being disposed to define a circuitous circumferential flow path from said third channel through said first channel, thence through said second channel and thence through said fourth channel to said fluid outlet port.

7. The burner nozzle as claimed in claim 1 wherein said channel defining means for said second channel is disposed for directing cooling flow in a second circumferential direction opposing the flow direction in said first channel.

* * * * *